US005407211A

United States Patent [19]

Bottiglieri

[11] Patent Number: 5,407,211

[45] Date of Patent: Apr. 18, 1995

[54] COMPACT ADJUSTABLE PORTABLE SPORTS PRACTICE NET

[75] Inventor: Peter Bottiglieri, Maple Ridge, Canada

[73] Assignee: T.S.T. Marketing Corporation, Maple Ridge, Canada

[21] Appl. No.: 131,408

[22] Filed: Oct. 1, 1993

[51] Int. Cl.[6] ..... A63B 63/04

[52] U.S. Cl. ..... 273/400; 273/26 A; 273/181 F

[58] Field of Search ..... 273/396, 398, 400, 401, 273/26 A, 29 A, 181 R, 181 F, 182 R, 411

[56] References Cited

U.S. PATENT DOCUMENTS

| | | | |
|---|---|---|---|
| 1,591,753 | 7/1926 | Flaugh | 273/26 A |
| 2,292,109 | 8/1942 | Engel | 273/26 A |
| 2,873,969 | 2/1959 | Ziel | 273/26 A |
| 2,944,816 | 7/1960 | Dixon | 273/26 A |
| 3,427,026 | 2/1969 | Mahoney | 273/26 A X |
| 4,210,326 | 7/1980 | Booth et al. | 273/26 A |
| 4,905,996 | 3/1990 | Tallent et al. | 273/26 A |

OTHER PUBLICATIONS

"Kwik Rebounder" p. 25 advertisement in 1993 catalogue of Kwik Goal Ltd., Quakertown, Pa.

"Training Goal" and Free Kick Wall pp. 26–27 advertisements in 1993 catalogue of Kwik Goal Ltd., Quakertown, Pa.

"Baseball Rebounder" p. 85 advertisement in 1993 catalogue of Kwik Goal Ltd., Quakertown, Pa.

*Primary Examiner*—William H. Grieb

*Attorney, Agent, or Firm*—Oyen Wiggs Green & Mutala

[57] ABSTRACT

A sports net having a rectangular frame with a lower, ground-engaging portion. A net is stretched over and fixed to the frame. The forward end of a base support is pivotally connected to a lower rearward portion of the ground-engaging frame portion, with the base support projecting horizontally away from the ground-engaging frame portion, without impeding ground engagement thereof. One end of a longitudinally adjustable tilt support is pivotally connected to an upper portion of the frame. The opposite end of the tilt support is pivotally connected to the rearward end of the base support. The base support and the tilt support are sized for longitudinal adjustment of the tilt support in any one of a range of positions to place the base support at an angle of between about 0° and 90° relative to the frame. In the 0° position the sports net structure is collapsed for compact storage. The tilt support can be fixed in any of the other positions to provide different rebound characteristics for balls or other objects projected onto the net.

5 Claims, 13 Drawing Sheets

COMPACT ADJUSTABLE PORTABLE SPORTS PRACTICE NET

FIELD OF THE INVENTION

This application pertains to a sports practice net which can be tilted to yield different ball rebound characteristics. The net is supported on a frame which is easily adjusted to tighten the net.

BACKGROUND OF THE INVENTION

Sports practice nets commonly have a frame to which a net is attached at multiple points around the frame. Over time, use of the net as a backstop in practising various ball type games tends to loosen the net relative to the frame. To tighten the net the user must sequentially release the net at each supporting point around the frame and reattach it to the frame in tighter fashion. The procedure is time consuming and requires the user to tighten the net alternately at spaced intervals around the frame so that the net will be uniformly taut.

Prior art sports practice nets tend to be bulky structures which are not easily erected or transported from one location to another. Accordingly, users tend to leave such nets erected in a single location. This risks deterioration of the net through exposure to the elements and means that the net is not always available for convenient use (for example, if access to the net is temporarily obstructed).

The present invention overcomes the foregoing disadvantages by providing a sports practice net which is easily adjusted to tighten the net on the frame. Sports practice nets constructed in accordance with the invention are also easily erected or dismantled, easily transported from one location to another, and can easily be stored while not in use.

SUMMARY OF THE INVENTION

In accordance with the preferred embodiment, the invention provides a sports net having a rectangular frame with a lower, ground-engaging portion. A net is stretched over and fixed to the frame. The forward end of a base support is pivotally connected to a lower rearward portion of the ground-engaging frame portion, such that the base support projects horizontally away from the ground-engaging frame portion, without impeding ground engagement thereof. One end of a longitudinally adjustable tilt support is pivotally connected to an upper portion of the frame. The opposite end of the tilt support is pivotally connected to the rearward end of the base support.

Advantageously, the base support and the tilt support are sized such that the tilt support can be longitudinally adjusted in any one of a range of positions to place the base support at an angle of between about 0° and 90° relative to the frame. In the 0° position the sports net structure is collapsed for compact storage. The tilt support can be fixed in any of the other positions to provide different rebound characteristics for balls or other objects projected onto the net.

At least one, but preferably a pair of side wings are provided for removable affixation on either side of the frame. Each side wing takes the form of a second rectangular frame having a second net stretched over and fixed to the second frame.

A pivotal coupling mechanism is provided for pivotally coupling the side wings to opposed sides of the frame. The pivotal coupling means preferably incorporates a sleeve fixed to the side of the main frame, and a coupling member having a first longitudinal portion fixed to the side wing. An arcuate portion of the coupling member is fixed at one end to the first longitudinal portion and extends perpendicularly away therefrom to a second end. A second longitudinal portion of the coupling member is fixed to the second end of the arcuate portion and extends perpendicularly away therefrom for slidable insertion into the sleeve.

A reel can be pivotally connected to the upper portion of the frame for pivotal movement of the reel between a storage position behind the frame and a deployment position forward of the frame. A drape net is wound upon the reel when the reel is in the storage position, and can be unwound from the reel when the reel is in the deployment position. A net support means is removably attach to each side wing to support the drape net in the deployment position.

Each rectangular side of the main frame may comprise a pair of slidably interconnected members, in which case a net tensioning mechanism can be provided for adjusting the tension of the net on the frame. The tensioning mechanism may take the form of a turnbuckle bridging each pair of slidably interconnected members. The turnbuckles can be adjusted as required to draw the members together or force them apart, thereby adjusting the tension of the net fixed to the frame.

For transporting the sports net between selected locations a transportation mechanism can be provided in the form of a pair of wheels rotatably connected in spaced relationship to a wheel support frame. A linkage means pivotally couples the wheel support frame to the lower portion of the frame, for pivotal movement of the wheel support frame between a transport position in which the wheels project beneath the frame and a storage position in which the wheels do not project beneath the frame.

BRIEF DESCRIPTION OF THE DRAWINGS

10A) and transportation (FIG. 10B) positions.

DETAILED DESCRIPTION OF THE PREFERRED EMBODIMENT

Figure 1:
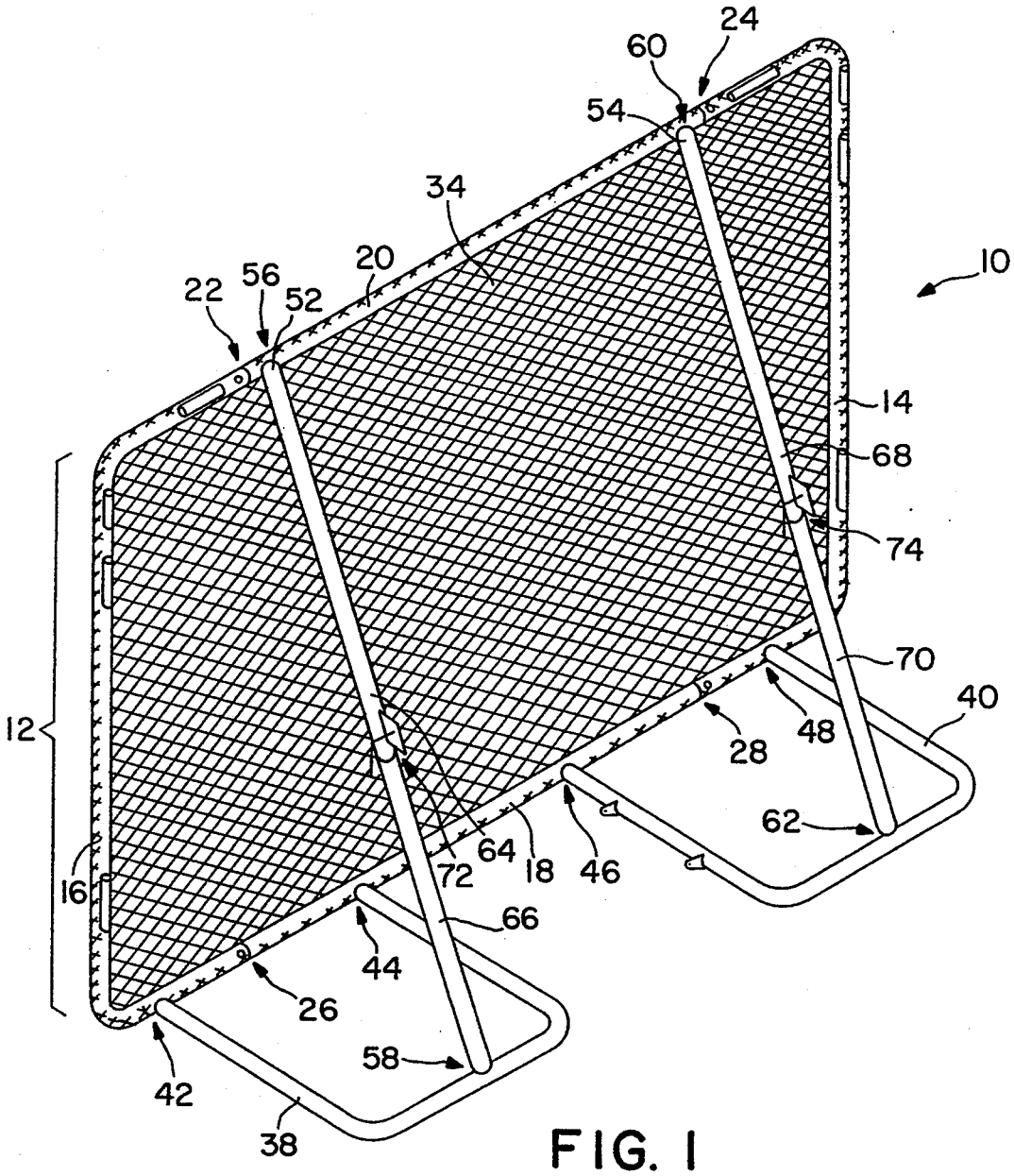
FIG. 1 is a rear pictorial illustration of a simplified sports practice net constructed in accordance with the invention.

Two embodiments of the invention will be described. FIGS. 1–5 depict a basic embodiment of the invention suitable for home use. FIGS. 6–10 depict a second embodiment of the invention having all of the features of the first embodiment and having a number of additional features likely to appeal to institutional users.

Referring first to the basic embodiment of FIGS. 1–5, sports net 10 has a rectangular frame 12 made up of two "U" shaped tubular end members 14, 16 and two longitudinal tubular members 18, 20. Longitudinal members 18, 20 are connected to U-shaped members 14, 16 at joints 22, 24, 26 and 28 respectively.

Figure 3:
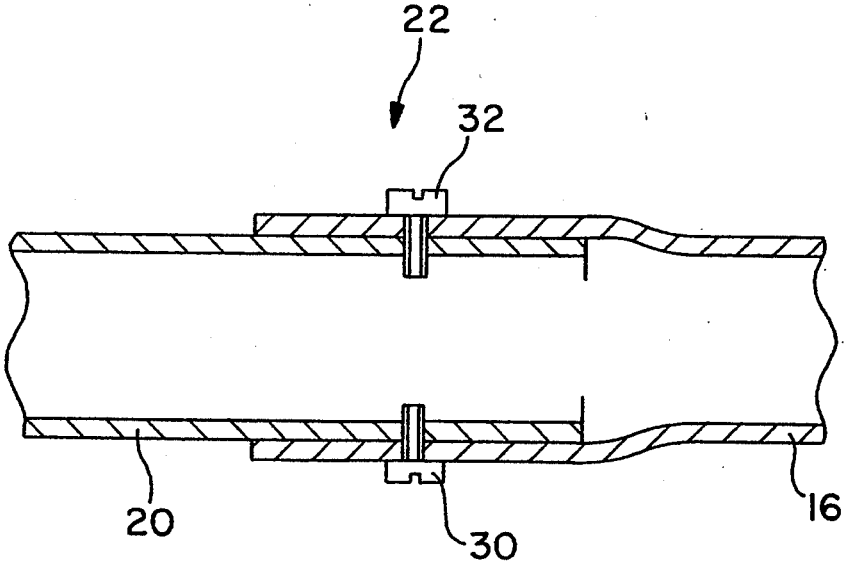
FIG. 3 is a cross-sectional illustration showing one of the frame member joints of the FIG. 1 net.

FIG. 3 shows joint 22 in greater detail. (Joints 22, 24, 26 and 28 are identical.) Specifically, the end of tubular member 16 has an enlarged diameter which is sized to slidably receive the end of longitudinal, tubular member 20 over a distance which is great enough to maintain alignment of member 20 relative to the longitudinal portion of member 12. Self-tapping screws 30, 32 can be passed through pre-drilled apertures in members 16, 20 to prevent rotation of the members relative to one another and to prevent withdrawal of member 20 from the enlarged end of member 16. If desired, the connection can be reversed, with mender 20 having an enlarged end for slidably receiving the end of tubular member 16.

Once frame members 14, 16, 18, 20 are interconnected as aforesaid to form rectangular frame 12 net 34 is attached to frame 12, for example by coupling a plurality of hooks to eyelets or similar members spaced around frame 12 and net 34, as described below in relation to FIG. 8.

Figure 4A:
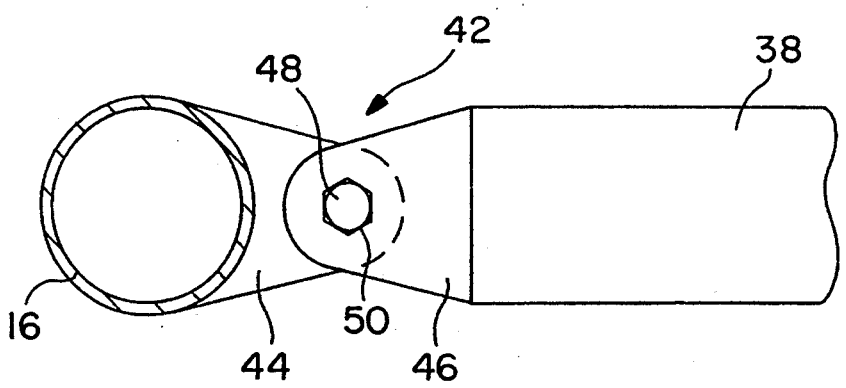
FIGS. 4A and 4B are respectively side elevation and top views of one of the hinge joints of the FIG. 1 net.
Figure 4B:
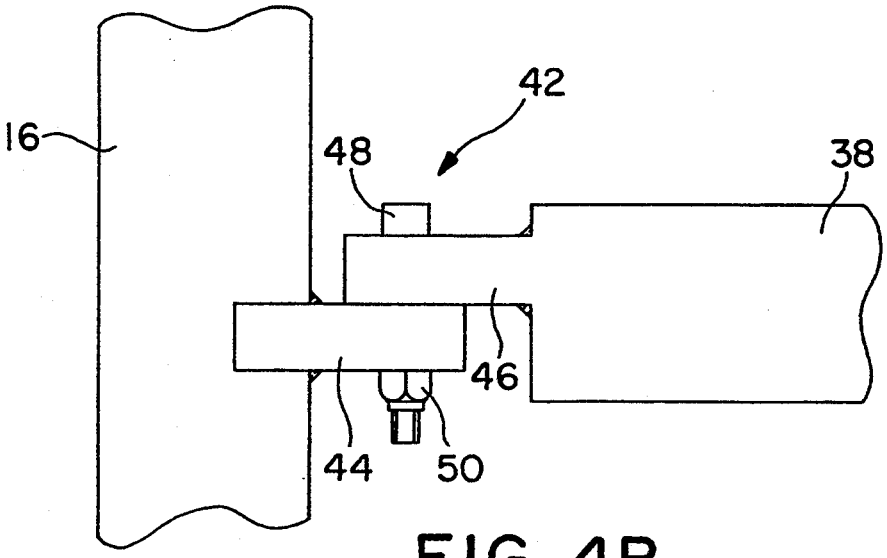

A pair of "U" shaped support members 38, 40 (FIG. 1) are pivotally connected to the base of frame 12 at joints 42, 44, 46 and 48 respectively. FIGS. 4A and 4B depict joint 42 ill greater detail. (Joints 44, 46 and 48 are identical to joint 42). Specifically, an apertured, rearwardly projecting flange 44 is welded onto the rear side of frame member 16; and, an apertured, forwardly-projecting flange 46 is welded onto the forward end of the corresponding portion of base support member 38. The apertures in flanges 44, 46 are aligned and bolt 48 is passed therethrough. Nut 50 is fastened over the protruding end of bolt 48 and tightened sufficiently to prevent free rotation of flanges 44, 46 on bolt 48 but not so tightly that flanges 44, 46 cannot rotate with respect to bolt 48 if a force is applied to tilt sports net 10 as hereinafter described.

Figure 5:
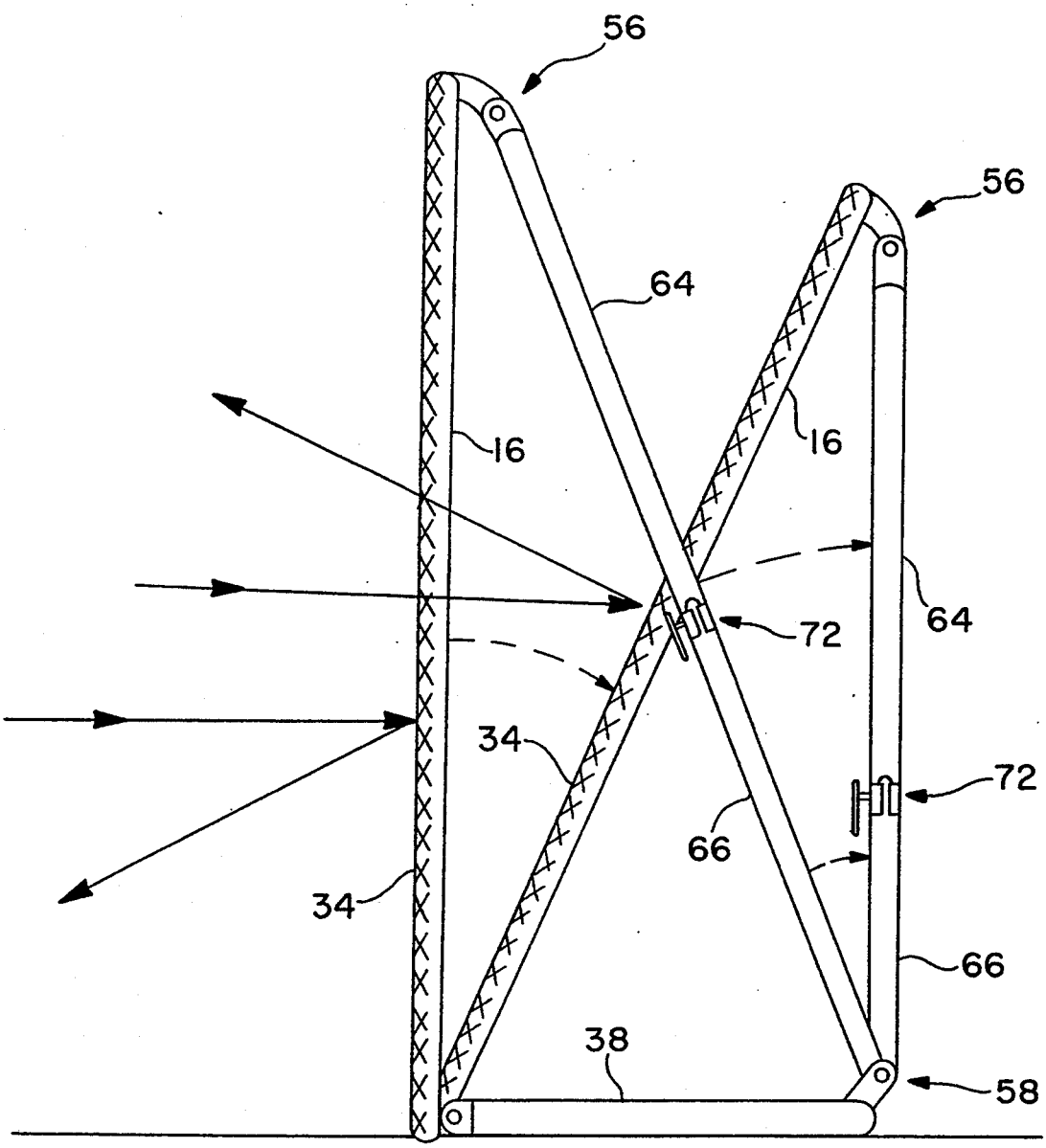
FIG. 5 is a schematic side elevation view of the FIG. 1 net, showing the relationship between the net frame, base support and tilt adjustment members in various positions.

As best seen in FIGS. 1 and 5, tubular member 18 and the longitudinally adjacent segments of members 14, 16 coupled thereto together comprise a "lower, ground-engaging portion" of frame 12. Base support members 38, 40 are pivotally connected to a lower rearward portion of the ground-engaging frame portion, so as not to impede engagement between frame 12 and the ground, along the ground-engaging frame portion. Such ground engagement stabilizes sports net 10 over a wide, four-corner base defined by the two lower corners of frame 12 and the two extreme outer, rearward corners of base support members 38, 40. This enables sports net 10 to remain erect, notwithstanding high impact forces imposed by kicking, throwing, etc. balls or other projectiles onto the net.

A pair of tilt adjusting members 52, 54 (FIG. 1) are pivotally connected between the rear side of upper longitudinal frame member 20 and the rear longitudinal portions of base support members 38, 40 respectively. More particularly, tilt adjusting member 52 is pivotally connected to members 20, 38 at joints 56, 58 respectively; and, tilt adjusting member 54 is pivotally connected to members 20, 40 at joints 60, 62 respectively. Joints 56, 58, 60 and 68 are identical to joint 42 described above with reference to FIGS. 4A and 4B.

Figure 2A:
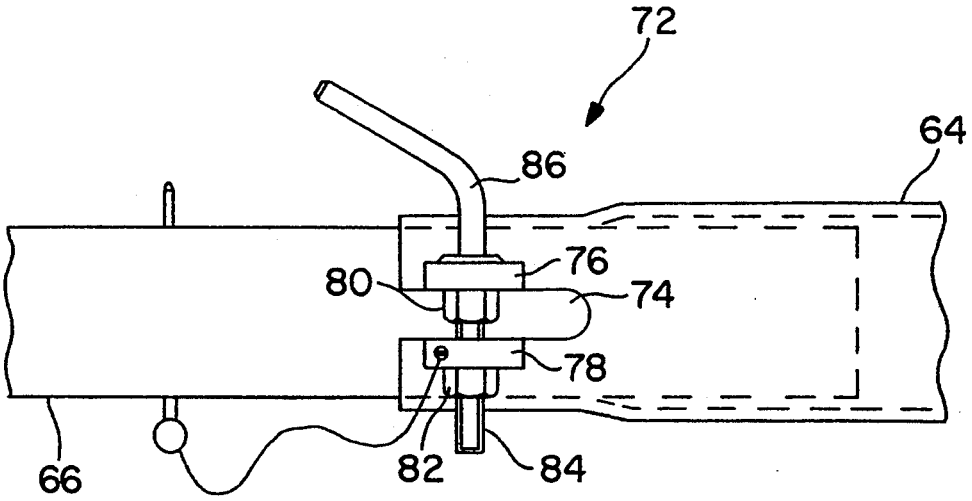
FIGS. 2A and 2B are respectively top and side elevation views of one of the tilt adjusting members of the FIG. 1 net.
Figure 2B:
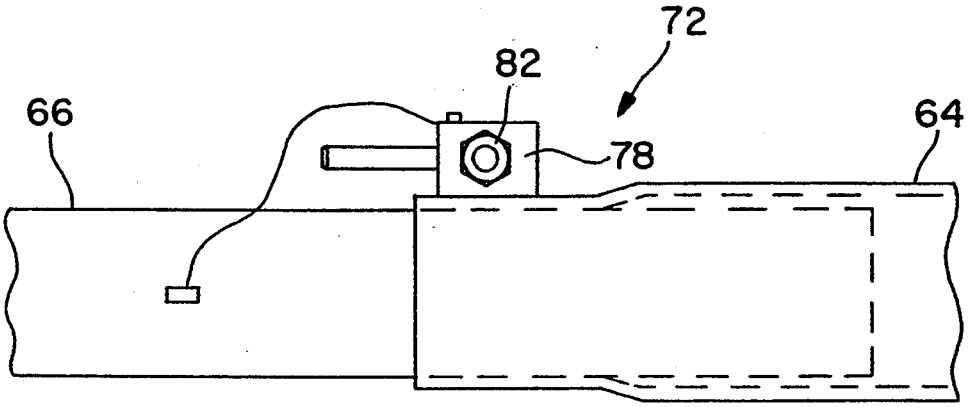

Tilt adjusting members 52, 54 each comprise a pair of telescopically interconnected tubular members. In particular, tilt adjusting member 52 comprises upper and lower tubular members 64, 66; and, tilt adjusting member 54 comprises upper and lower tubular members 68, 70. Members 64, 66 are telescopically interconnected at joint 72; and, members 68, 70 are telescopically interconnected at joint 74. FIGS. 2A and 2B depict joint 72 in greater detail. (Joint 74 is identical to joint 72.) As shown in FIGS. 2A and 2B, the lower end of tubular member 64 has a reduced diameter which is sized to slidably receive the upper end of lower tubular mender 66. A longitudinal slot 74 is provided in the lower end of member 64. Outwardly protruding flanges 76, 78 are welded to member 64 on either side of slot 74. Aligned apertures (not shown) are provided in each of flanges 76, 78. Threaded nuts 80, 82 are fastened to lever 86 and flange 78 respectively in alignment with the flange apertures aforesaid. The threaded portion 84 of tightening lever 86 is threadably advanced through nuts 80, 82 as best seen in FIG. 2A, thereby drawing flanges 76, 78 toward one another thereby reducing the diameter of member 64 in the vicinity of slot 74 and consequently firmly gripping the upper end of member 66 within the lower end of member 64.

Tilt adjusting members 52, 54 in combination with the pivotal joints aforesaid facilitate deployment of sports net 10 in a range of different positions. FIG. 5 shows two such positions. In the left-most depiction tilt extension members 52, 54 are at full extension: the members comprising frame 12 stand substantially vertically relative to base support members 38, 40 which rest on an appropriate support surface such as a patch of level ground, driveway, etc. In the right-most depiction tilt adjusting members 52, 54 are telescopically collapsed, relative to the left-most depiction, reducing the angle between frame 12 and base support members 38, 40 by about 30°. It will thus be understood that members 52, 54 can be telescopically adjusted to position base support members 38, 40 at different acute angles of tilt between 0° and 90° relative to frame 12. In the 0° position base support members 38, 40 and tilt adjusting members 52, 54 are almost parallel to frame 12, thus achieving a very compact structure in which sports net 10 can be stored when not in use. The user tightens lever 86 at each of joints 72, 74 to fix any desired tilt position of frame 12 relative to base support members 38, 40. That is, sports net 10 can be adjusted for use with net 34 inclined rearwardly at a desired angle. This is useful, for example, to achieve different rebound characteristics when balls are kicked, thrown or otherwise projected onto net 34. The arrows shown to the left in FIG. 5 illustrate the different rebound characteristics of balls which strike net 34 from a horizontal trajectory, for the two net adjustment positions shown in FIG. 5.

Reference is now made to the second embodiment of the invention shown in FIGS. 6–10. As previously indicated, the second embodiment incorporates all of the features of the basic embodiment described above with reference to FIGS. 1–5. Accordingly, the following description of the second embodiment is confined to features thereof which have not previously been described in relation to the first embodiment.

Figure 6:
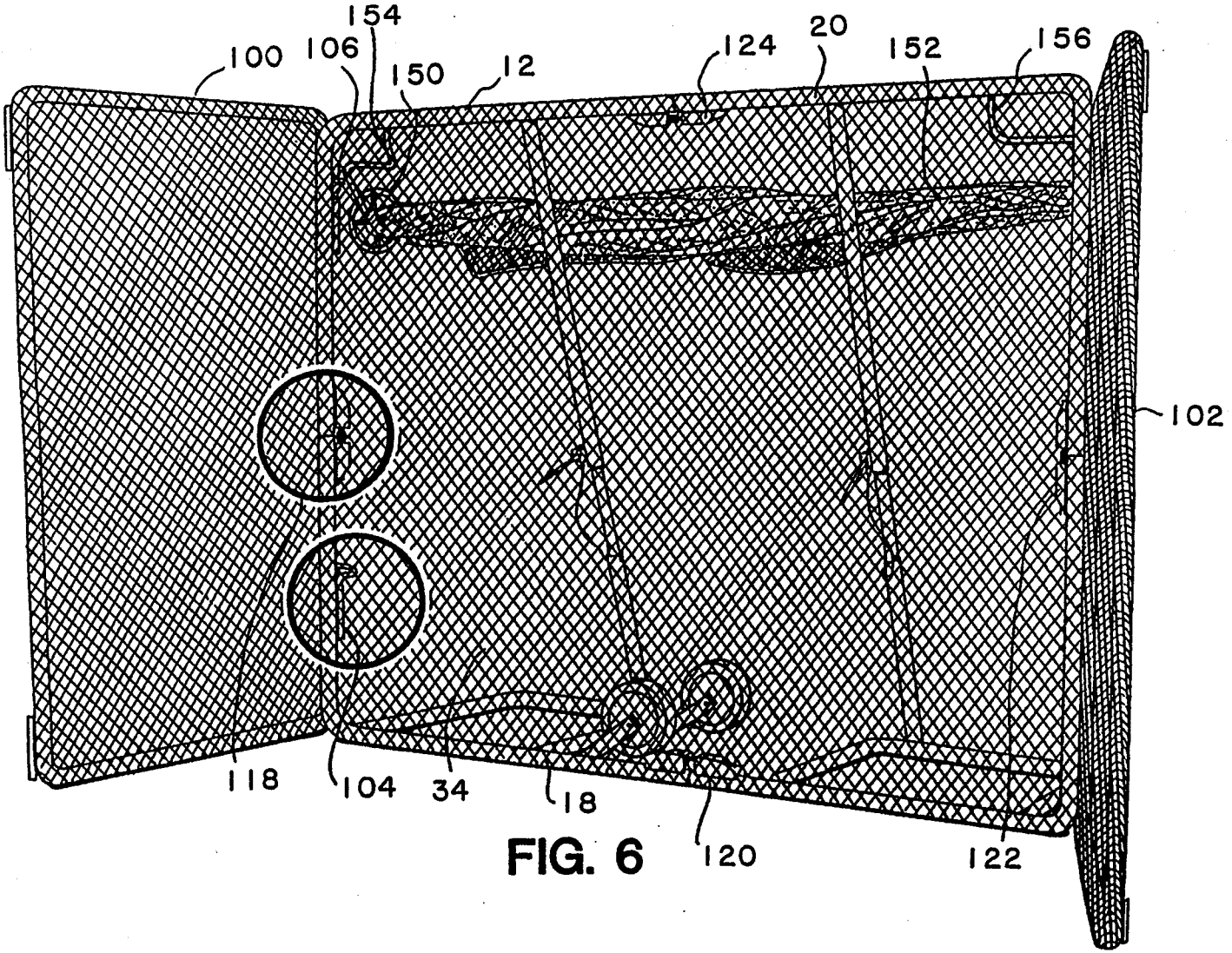
FIG. 6 is a pictorial illustration of a second embodiment of the invention having removable side wings and having a drape net which is shown in the storage position in FIG. 6.
Figure 7:
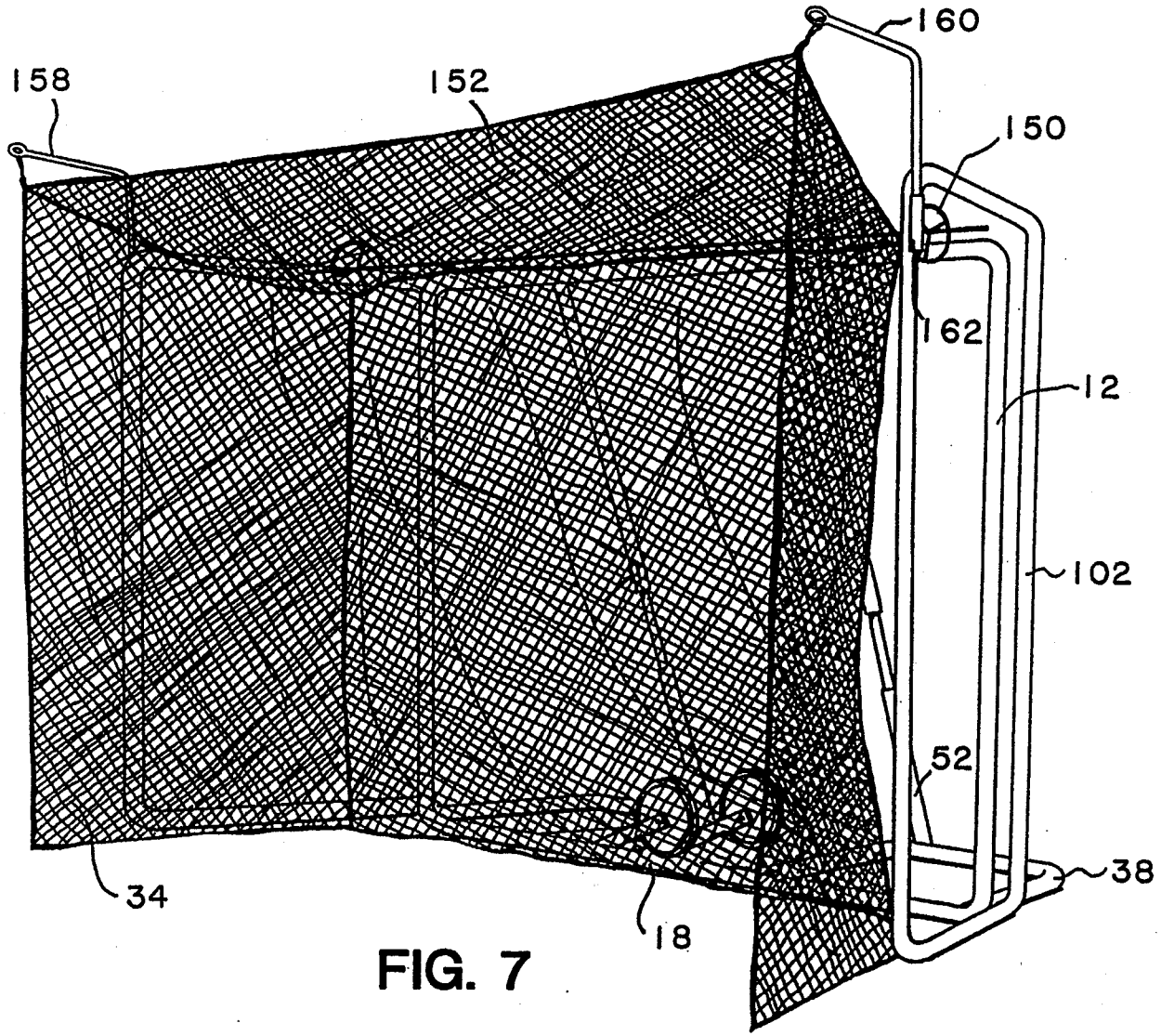
FIG. 7 is similar to FIG. 6, but shows the drape net in its deployed position.

As shown in FIGS. 6 and 7, a pair of netted side wings 100, 102 can be pivotally attached to either side of frame 12. Wings 100, 102 serve to confine balls which miss the main surface of net 34 on frame 12. For example, novice soccer players may be unable to kick a ball with sufficient accuracy to consistently hit a point within rectangular frame 12. Side wings 100, 102 extend the available target area, thus reducing the likelihood that novice users will have to chase after balls which miss sports net 10 altogether. Except for their rectangular dimensions, side wings 100, 102 are each identical in construction to frame 12 and net 34.

Side wing 100 is pivotally connected to one side of frame 12 at joints 104, 106 respectively. An identical pair of joints (not shown) are used to connect side wing 102 to the opposite side of frame 12. FIG. 8 depicts joint 104 in more detail. (All of the joints used to connect side wings 100, 102 to frame 12 are identical to joint 104.) Specifically, FIG. 8 illustrates a portion of the tubular frame member 108 of side wing 100 and a portion of the tubular member 14 of frame 12. A sleeve 110 is welded to member 14 in longitudinal alignment therewith. One longitudinally projecting end 112 of linkage member 114 is welded to frame member 108 in longitudinal alignment therewith. Linkage member 114 has a second longitudinally projecting portion 116 which is parallel to portion 112 but which projects in the opposite direction. Portion 116 is slidably received within sleeve 110. The extended, arcuate shape of linkage member 114 facilitates pivotal movement of frame members 14, 108 relative to one another in a simple, sturdy, easily manipulated fashion.

Figure 8:
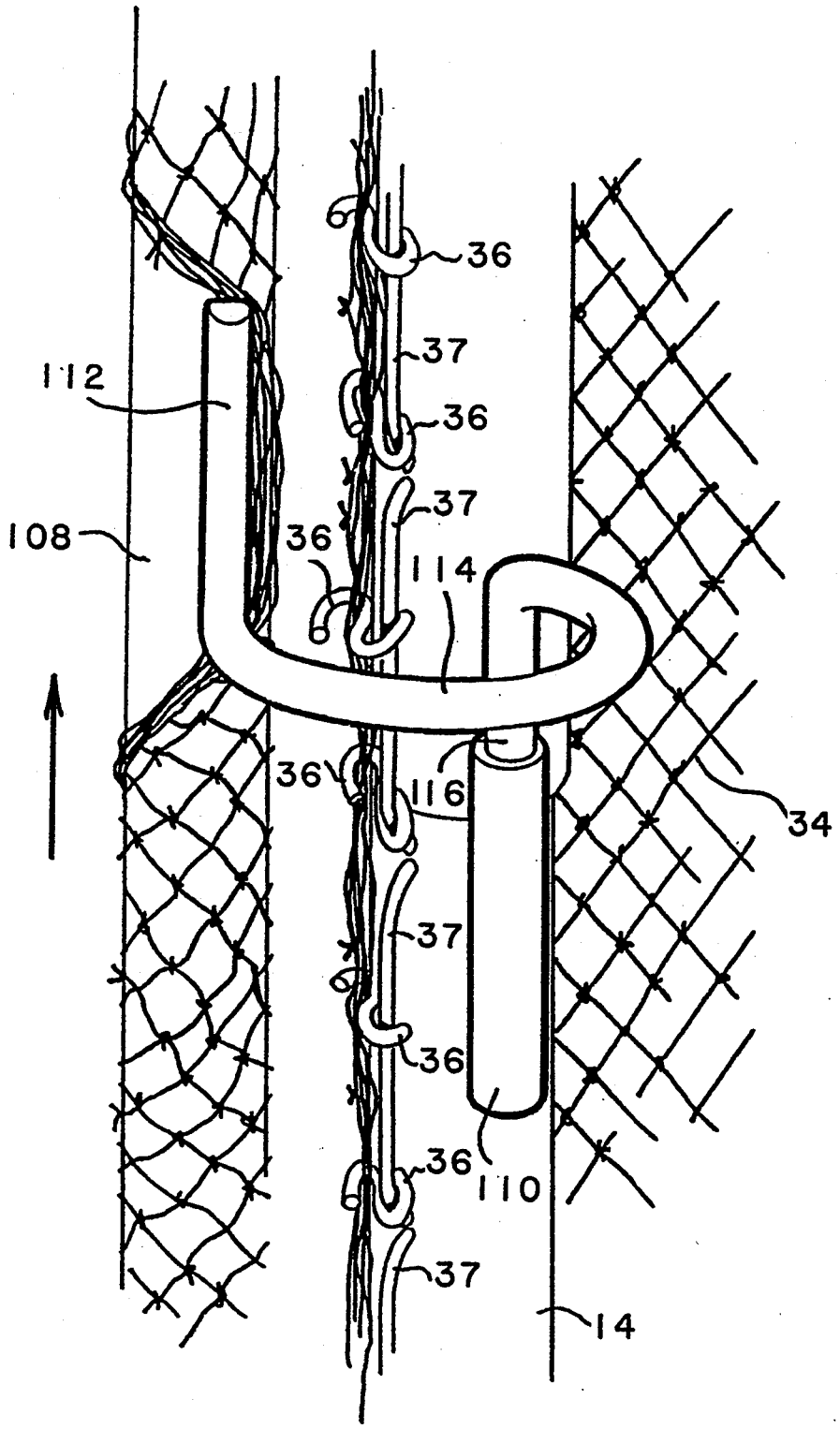
FIG. 8 is an enlarged illustration of one of the hinge members which interconnect the wings to the frame of the FIG. 6 net.

FIG. 8 also shows how net 34 can be attached to frame 12 by coupling a plurality of S-shaped hooks 36 between net 34 and suitable brackets or eyelets 37 fixed to each of the members comprising frame 12 and spaced around the frame.

Figure 9:
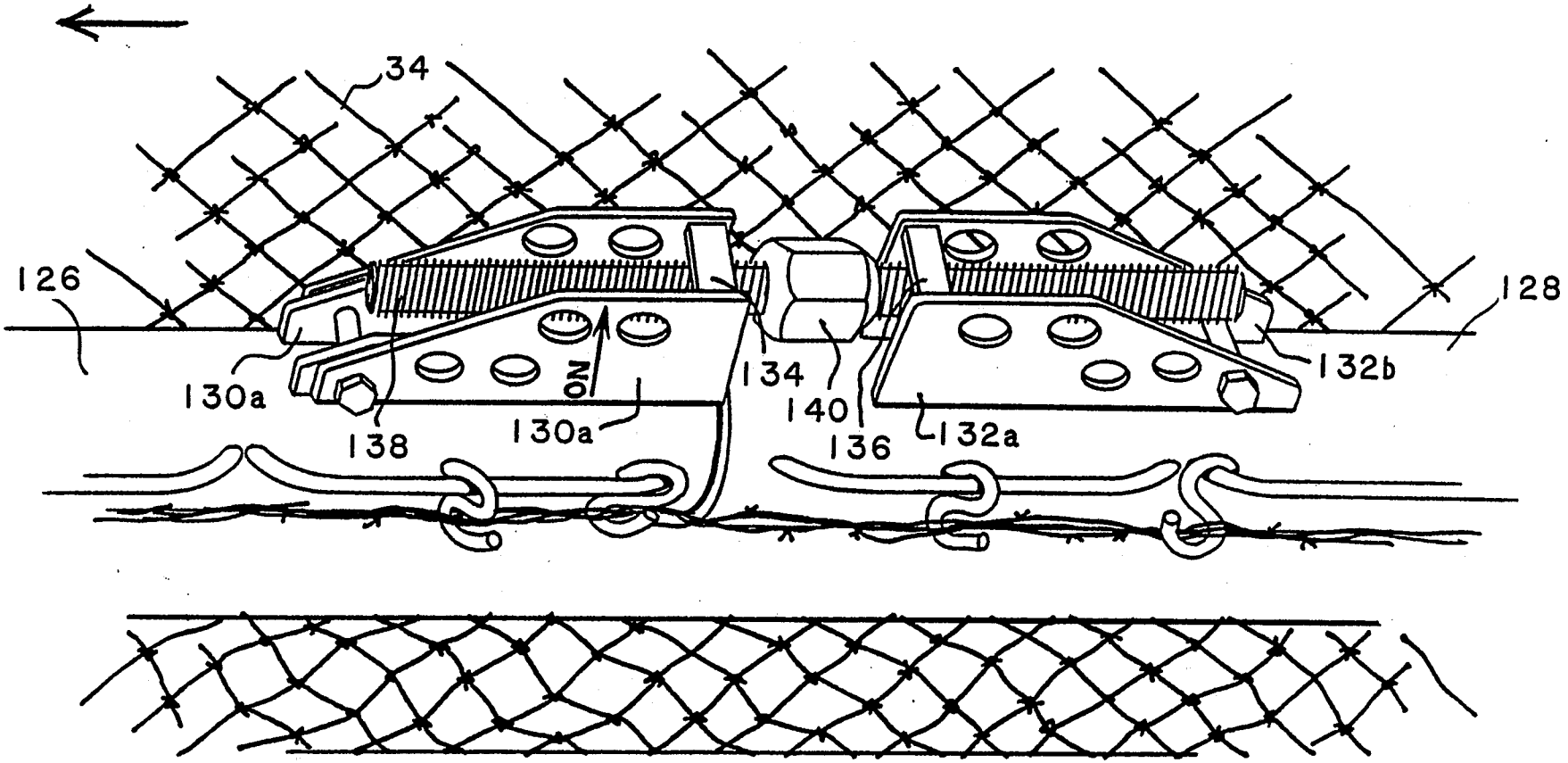
FIG. 9 is an enlarged illustration of one of the net tension adjusting mechanisms of the FIG. 6 net.

FIG. 9 illustrates one of four turnbuckle mechanisms 118, 120, 122 and 124 which can optionally be provided on each of frame members 14, 16, 18 and 20 to assist in tightening net 34 on frame 12. As shown in FIG. 9, this is accomplished by forming each frame member of two telescopically interconnected tubular segments 126, 128. Paired flanges **130*a*, 130*b* and 132*a*, 132*b* are welded onto the slidably interconnected ends of members 126, 128 respectively. These flanges respectively support transverse apertured flanges 134, 136 which have aligned, threaded apertures. Turnbuckle 138 having oppositely directed threads on its opposed ends is threaded through the aforesaid apertures of flanges 134, 136. A wrench (not shown) is used to rotate turnbuckle nut 140 in order to draw flanges 134, 136 toward one another or force them apart, thereby respectively drawing frame members 126, 128 together or sliding them apart. Because net 34 is fastened to the frame members as aforesaid this serves to tighten the net in the vicinity of turnbuckle 138**, thereby vastly simplifying the process of tightening the net.

FIGS. 6 and 7 also depict an optional reel 150 which can be deployed in either the storage position shown in FIG. 6 or in the operative position shown in FIG. 7. As depicted in FIG. 6, a drape net 152 is rolled upon reel 150 and stored out of the way behind tilt adjusting members 52, 54. Linkage arms 154, 156 pivotally connect reel 150 to upper frame member 20. Joints (not shown) like those described above with reference to FIG. 8 can be used for this purpose. To deploy net 152 reel 150 is rotatably pivoted from behind tilt adjusting members 52, 54 to a position overhanging upper frame member 20 (FIG. 7). Net 152 is unwound from reel 150 and supported, at its forward ends, from arms 158,160 which are slidably mounted in sleeves provided on the upper forward ends of the frame members comprising side wings 100, 102 respectively (only one such sleeve 162 is visible in FIG. 7). Net 152 has an open-fronted cage-like shape and can be used as a batter's cage or to trap balls driven into net 152. That is, unlike net 34 which is stretched tautly over frame 12, net 152 hangs loosely from support arms 158, 160 and is not intended to have any ball rebound characteristics. Rather, net 152 is intended to stop balls which are driven into it.

Figure 10A:
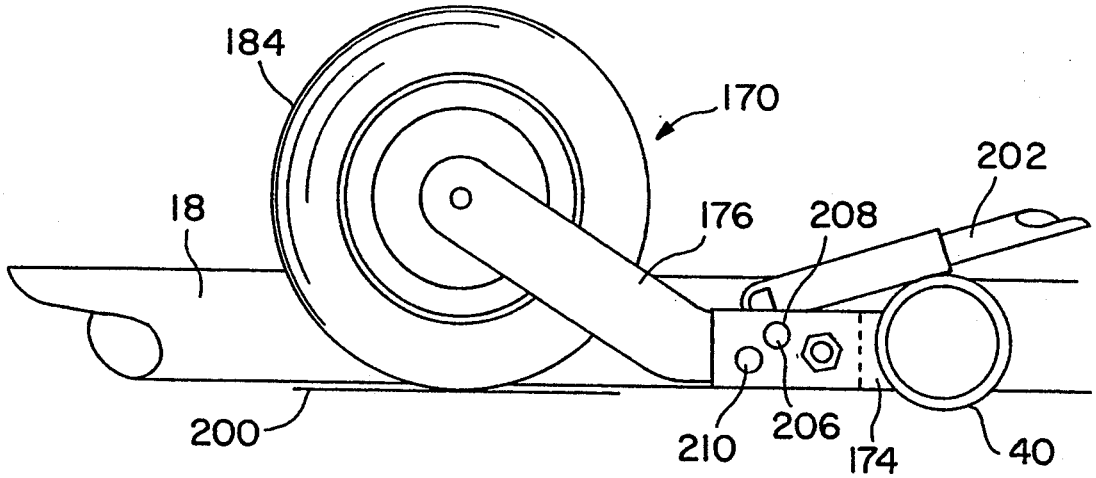
FIGS. 10A and 10B are respectively side elevation views showing the wheeled mechanism used to transport the net, with the mechanism in its storage (FIG.
Figure 10B:
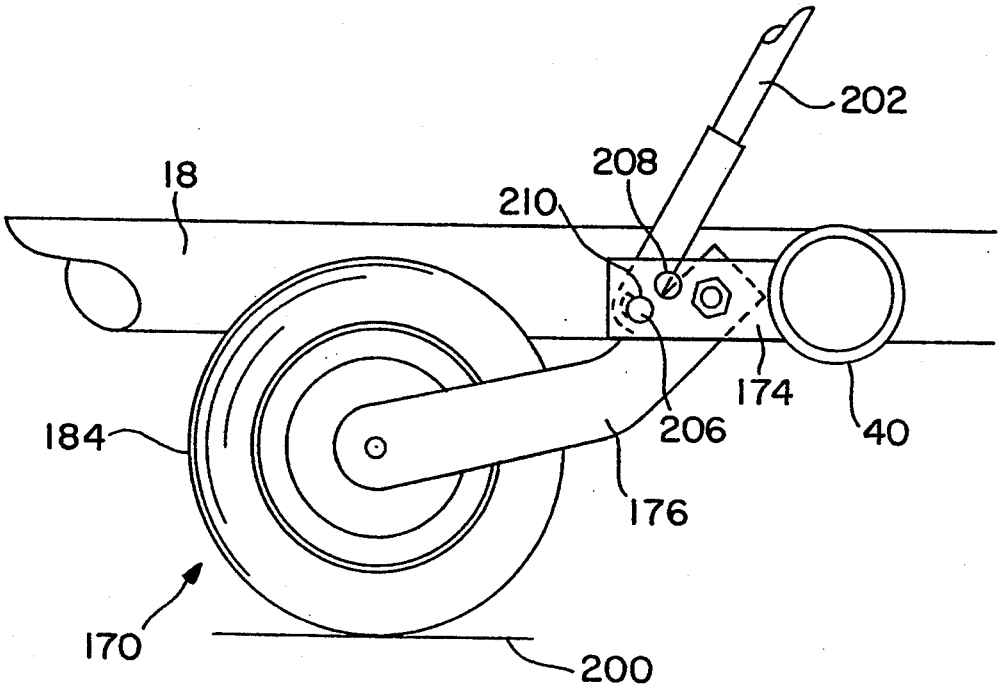
Figure 10C:
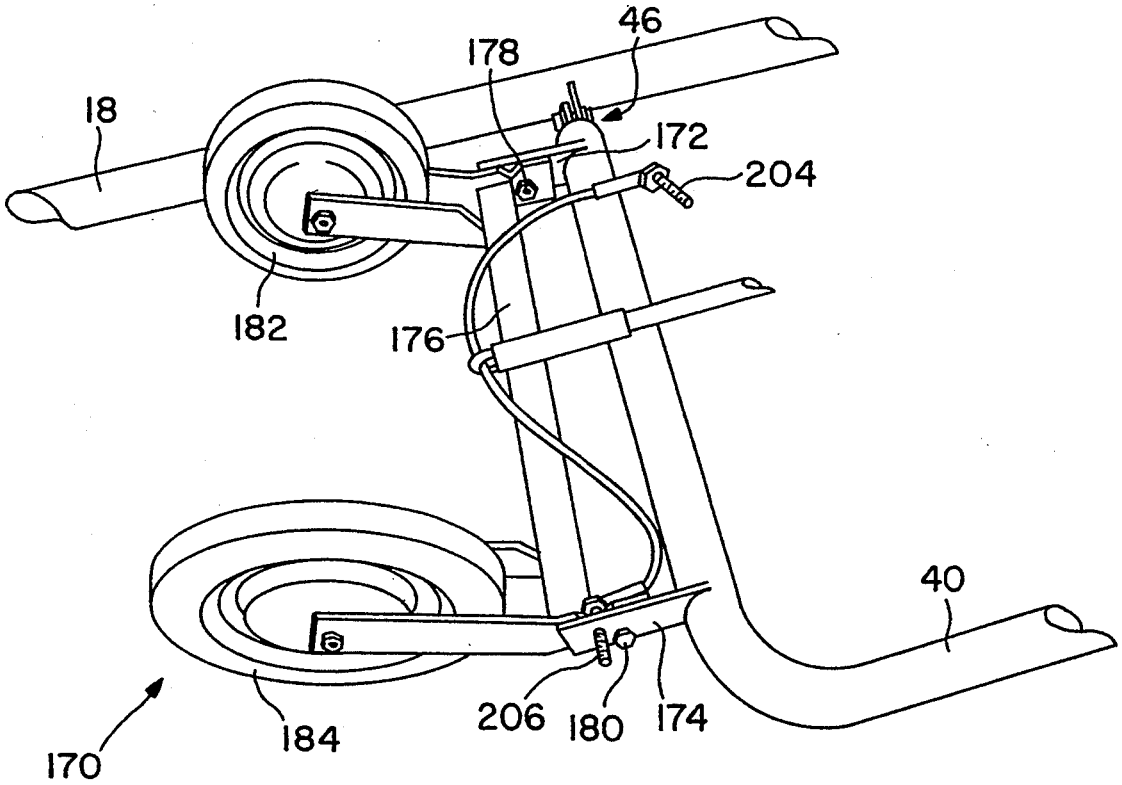
FIG. 10C is a pictorial view showing the wheel transportation mechanism in the storage position.

FIGS. 10A, 10B and 10C illustrate a wheeled transportation device 170 (also visible in FIGS. 6 and 7) which can be used to conveniently transport the sports net structure from one location to another. Specifically, a pair of spaced flanges 172, 174 are welded onto the inner most of the two legs of base support member 40 which are pivotally coupled to lower frame member 18 at joints 46, 48 respectively. "U" shaped bracket 176 is pivotally mounted between flanges 172,174 by mounting nuts 178, 180. Wheels 182, 184 are in turn rotatably mounted on the respective ends of bracket 176. Bracket 176 normally holds wheels 182, 184 in the position shown in FIG. 10A (i.e. frame member 18 is resting upon support surface 200). When the net structure is to be transported lever bar 202 is raised away from the position shown in FIG. 10A into the position shown in FIG. 10B. This forces mounting bracket 176 downwardly relative to the position shown in FIG. 10A; or, more particularly, raises frame member 18 relative to wheels 182,184 which continue to rest upon support surface 200. Removable locking pins 204, 206 are provided. As seen in FIG. 10A, pin 206 is fitted through a pair of apertures 208 in mounting bracket 176 and flange 174 which apertures are aligned when the net structure is in the position shown in FIG. 10A. FIG. 10B shows locking pin 206 disposed within a different aperture in flange 174 in which pin 206 holds bracket 176 in the position shown in FIG. 10B, thereby keeping the net structure in its raised position relative to wheels 182, 184. In this position the user can easily grasp one end of the net structure and push or pull the structure along on wheels 182, 184.

Figure 11A:
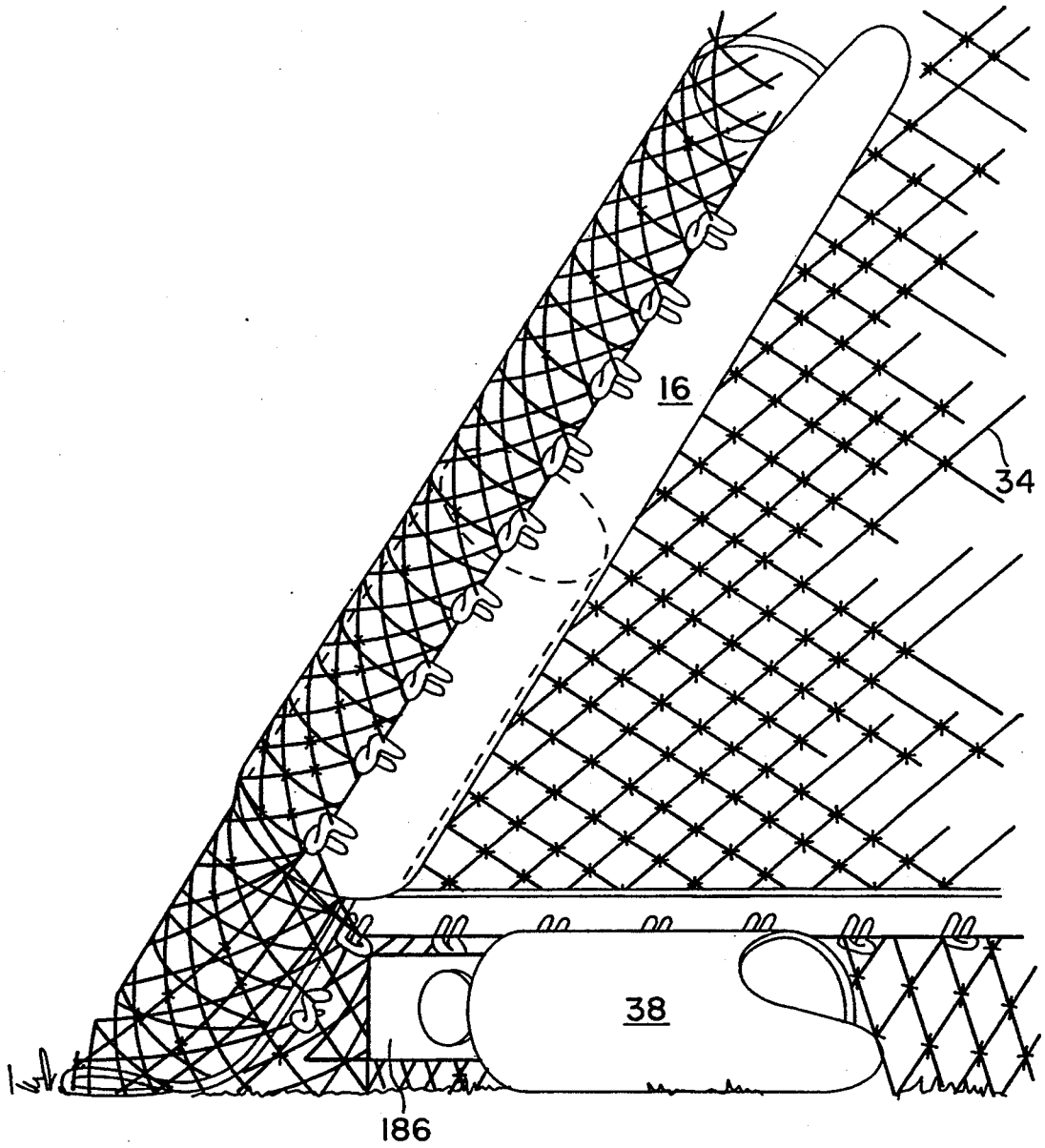
FIG. 11A is a partially fragmented, oblique rear perspective view of the lower front corner portion of an embodiment of the invention incorporating an alternative lower longitudinal support member.
Figure 11C:
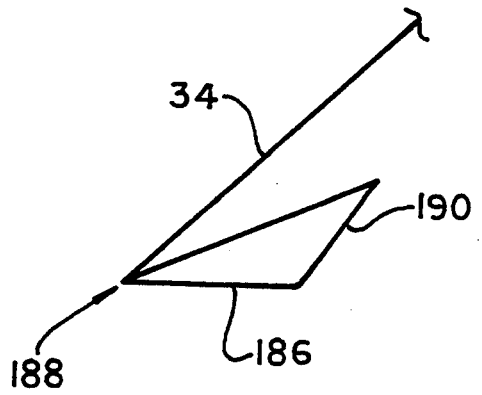
FIG. 11C is a simplified cross-sectional view of the alternative lower longitudinal support member, taken with respect to line 11C—11C of FIG. 11B.
Figure 11B:
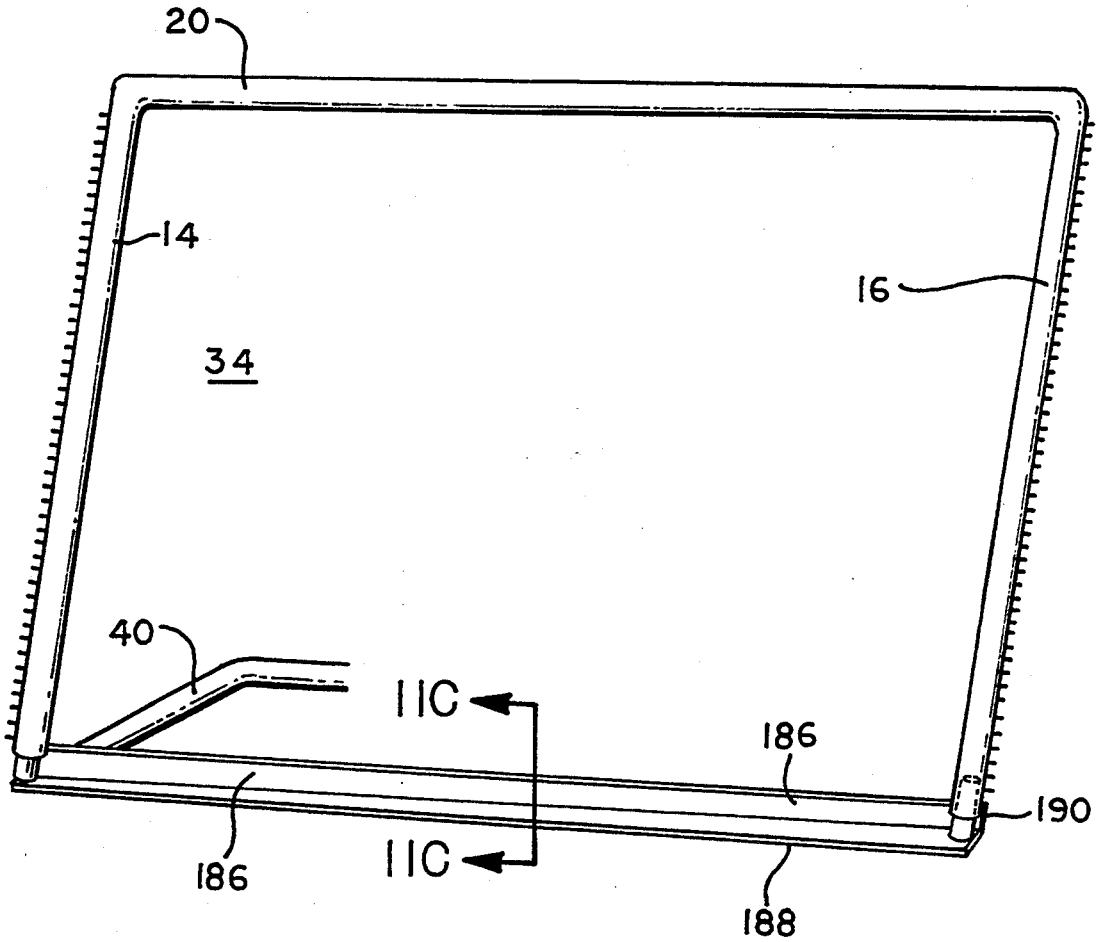
FIG. 11B is a schematic depiction of the FIG. 11A embodiment, seen from the front, with the portion depicted in FIG. 11A encircled.

FIGS. 11A, 11B and 11C depict an embodiment of the invention incorporating an alternative lower longitudinal support member 186. Unlike tubular support member 18 which has a round cross-section, member 186 is formed of angle iron having an obtuse-angled cross-section. As best seen in FIG. 11C, this cross-section enables member 186 to support net 34 along a thin contact line where the forward edge 188 of member 186 meets net 34. Consequently, the upwardly protruding, rearward face 190 of member 186 does not contact balls projected onto the lower part of net 34, even if net 34 deflects rearwardly upon contact with the ball. By contrast, a support member having a tubular cross-section, such as member 18, will contact balls projected onto the her's lower edge. This causes undesirable "skipping" of the ball and interferes with certain ball control skill exercises such as those in which the user attempts to roll a soccer ball along the ground into the lowermost part of sports net 10.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A sports net, comprising:

(a) a rectangular frame having a lower, ground-engaging portion;

(b) a net stretched over and fixed to said frame;

(c) base support means having a forward end and a rearward end, said forward end pivotally connected to a lower rearward portion of said ground-engaging frame portion for horizontal projection of said base support means away from said ground-engaging frame portion, without impeding ground engagement of said ground-engaging frame portion;

(d) longitudinally adjustable tilt support means having a first end pivotally connected to an upper portion of said frame and a second end pivotally connected to said rearward end of said base support means, said base support means and Said tilt support means being sized for longitudinal adjustment of said tilt support means in any one of a range of positions in which said base support means is at an angle of between about 0° and 90° relative to said frame;

(e) means for fixing said tilt support means in any one of said positions;

(f) at least one side wing removably fixable to one side of said frame, said side wing comprising a second rectangular frame and a second net stretched over and fixed to said second frame;

(g) pivotal coupling means for pivotally coupling said side wing to opposed sides of said frame, said pivotal coupling means comprising:

(i) a sleeve fixed to said frame side;

(ii) a coupling member comprising:

(A) a first longitudinal portion fixed to said side wing;

(B) an arcuate portion fixed at one end to said first longitudinal portion and extending perpendicularly away therefrom to a second end; and, (C) a second longitudinal portion fixed to said second end of said arcuate portion and extending perpendicularly away therefrom for slidable insertion into said sleeve.

2. A sports net, comprising:

(a) a rectangular frame having a lower, ground-engaging portion;

(b) a net stretched over and fixed to said frame;

(c) base support means having a forward end and a rearward end, said forward end pivotally connected to a lower rearward portion of said ground-engaging frame portion for horizontal projection of said base support means away from said ground-engaging frame portion, without impeding ground engagement of said ground-engaging frame portion;

(d) longitudinally adjustable tilt support means having a first end pivotally connected to an upper portion of said frame and a second end pivotally connected to said rearward end of said base support means, said base support means and said tilt support means being sized for longitudinal adjustment of said tilt support means in any one of a range of positions in which said base support means is at an angle of between about 0° and 90° relative to said frame;

(e) means for fixing said tilt support means in any one of said positions;

(f) at least One side wing removably fixable to one side of said frame, said side wing comprising a second rectangular frame and a second net stretched over and fixed to said second frame;

(g) a reel pivotally connected to and extending parallel to said upper portion of said frame for pivotal movement of said reel between a storage position behind said frame and a deployment position forward of said frame; and, (h) a drape net coupled to said reel for winding of said drape net upon said reel when said reel is in said storage position, and for unwinding of said drape net from said reel when said reel is in said deployment position.

3. A sports net as defined in claim 2, further comprising drape net support means removably attachable to said side wings for supporting said drape net in said deployment position.

4. A sports net, comprising:.

(a) a rectangular frame having a lower, ground-engaging portion;

(b) a net stretched over and fixed to said frame;

(c) base support means having a forward end and a rearward end, said forward end pivotally connected to a lower rearward portion of said ground-engaging frame portion for horizontal projection of said base support means away from said ground-engaging frame portion, without impeding ground engagement of said ground-engaging frame portion;

(d) longitudinally adjustable tilt support means having a first end pivotally connected to an upper portion of said frame and a second end pivotally connected to said rearward end of said base support means, said base support means and said tilt support means being sized for longitudinal adjustment of said tilt support means in any one of a range of positions in which said base support means is at an angle of between about 0° and 90° relative to said frame; and, (e) means for fixing said tilt support means in any one of said positions;

wherein each rectangular side of said frame comprises a pair of slidably interconnected members and further comprising net tensioning means for adjusting the tension of said net on said frame, said tensioning means comprising a turnbuckle bridging each of said slidably interconnected members for adjustably drawing said members together or forcing them apart.

5. A sports net, comprising:

(a) a rectangular frame having a lower, ground-engaging portion;

(b) a net stretched over and fixed to said frame;

(c) base support means having a forward end and a rearward end, said forward end pivotally connected to a lower rearward portion of said ground-engaging frame portion for horizontal projection of said base support means away from said ground-engaging frame portion, without impeding ground engagement of said ground-engaging frame portion;

(d) longitudinally adjustable tilt support means having a first end pivotally connected to an upper portion of said frame and a second end pivotally connected to said rearward end of said base support means, said base support means and said tilt support means being sized for longitudinal adjustment of said tilt support means in any one of a range of positions in which said base support means is at an angle of between about 0° and 90° relative to said frame;

(e) means for fixing said tilt support means in any one of said positions; and (f) a lower longitudinal support member having an upwardly protruding face spaced rearwardly away from said net, said face projecting upwardly and rearwardly to prevent contact between said rearward face and said net.

* * * * *